US007361063B2

(12) United States Patent
Mullin et al.

(10) Patent No.: US 7,361,063 B2
(45) Date of Patent: Apr. 22, 2008

(54) SHIELDED CONNECTING BLOCK PROVIDING REDUCED ALIEN CROSSTALK

(75) Inventors: Daniel J. Mullin, Plantsville, CT (US); Brian Celella, Southington, CT (US); Vito Pagliarulo, Bristol, CT (US); Mark Navarra, Oakville, CT (US); Olindo Savi, Kensington, CT (US); Vinicio Crudele, Watertown, CT (US); Douglas Bond, Thomaston, CT (US); Michael Weed, Cheshire, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 11/546,095

(22) Filed: Oct. 11, 2006

(65) Prior Publication Data

US 2007/0082540 A1 Apr. 12, 2007

Related U.S. Application Data

(60) Provisional application No. 60/725,478, filed on Oct. 11, 2005.

(51) Int. Cl.
*H01R 24/00* (2006.01)

(52) U.S. Cl. ..... 439/676; 439/607; 439/931

(58) Field of Classification Search ..... 439/607–610, 439/676, 931

See application file for complete search history.

(56) References Cited

U.S. PATENT DOCUMENTS 4,824,383 A * 4/1989 Lemke ..... 439/108
6,572,411 B1 * 6/2003 Aeschbacher et al. . 439/620.21

* cited by examiner

*Primary Examiner*—Khiem Nguyen
(74) *Attorney, Agent, or Firm*—Cantor Colburn LLP

(57) ABSTRACT

A patch panel includes a first outlet having a first connecting block; a second outlet having a second connecting block, the second connecting block positioned adjacent to the first connecting block; a conductive shield positioned between the first connecting block and the second connecting block to reduce alien crosstalk.

7 Claims, 4 Drawing Sheets

SHIELDED CONNECTING BLOCK PROVIDING REDUCED ALIEN CROSSTALK

CROSS-REFERENCE TO RELATED APPLICATIONS

This application claims the benefit of U.S. provisional patent application Ser. No. 60/725,478, filed Oct. 11, 2005, the entire contents of which are incorporated herein by reference.

BACKGROUND

The invention relates generally to telecommunications components, and in particular to telecommunications components designed to reduce alien crosstalk. In an electrical communication system, it is sometimes advantageous to transmit information signals (video, audio, data) over a pair of wires (hereinafter "wire-pair" or "differential pair") rather than a single wire, wherein the transmitted signal comprises the voltage difference between the wires without regard to the absolute voltages present. Each wire in a wire-pair is susceptible to picking up electrical noise from sources such as lightning, automobile spark plugs and radio stations to name but a few. Because this type of noise is common to both wires within a pair, the differential signal is typically not disturbed. This is a fundamental reason for having closely spaced differential pairs.

Alien crosstalk is the differential crosstalk that occurs between communication channels. To reduce this form of alien crosstalk, shielded systems containing shielded twisted pairs or foiled twisted pair configurations may be used. However, the inclusion of shields can increase cost of the system. Another approach to reduce or minimize alien crosstalk utilizes spatial separation of cables within a channel and/or spatial separation between the jacks in a channel. However, this is typically impractical because bundling of cables and patch cords is common practice due to "real estate" constraints and ease of wire management.

Thus, there is a need in the art for telecommunications components that reduce or minimize alien crosstalk between communications channels.

SUMMARY

An embodiment of the invention is a patch panel comprising: a first outlet having a first connecting block; a second outlet having a second connecting block, the second connecting block positioned adjacent to the first connecting block; a conductive shield positioned between the first connecting block and the second connecting block to reduce alien crosstalk.

DETAILED DESCRIPTION

Embodiments of the invention provide category 6 augmented compliant components for the new IEEE 802.3an 10GBASE-T application which is furthered defined in the draft TIA/EIA-568-B.2-10 Augmented category 6 draft. Connectors, cables, and patch cords are expected to meet the new alien near end crosstalk (ANEXT) and alien far end crosstalk (AFEXT) requirements. The alien crosstalk requirements are defined by limits in the TIA/EIA-568-B.2-10 draft and are called powersum alien NEXT and powersum alien equal level far end crosstalk (ELFEXT). These limits were defined to minimize noise from one connector or channel to another.

Market trends have shown a need for faster networks with greater bandwidth. The Institute of Electrical and Electronics Engineers (IEEE) has established a project team (formally known as IEEE 802.3an™) to develop 10 Gigabit Ethernet that would operate over structured twisted pair cabling.

The IEEE project team has identified alien crosstalk to be the most dominant noise source in the proposed channel. A channel is comprised of horizontal cable, connectors and patch cords. The "channel" is designed to meet minimum performance criteria to ensure its ability to transmit the given application such as 10 Gigabit Ethernet. The Telecommunications Industry Association (TIA) is given the task of defining the cable, cord and connector requirements in support of the "channel" requirements needed to guarantee 10 Gigabit Ethernet transmissions.

Figure 1A:
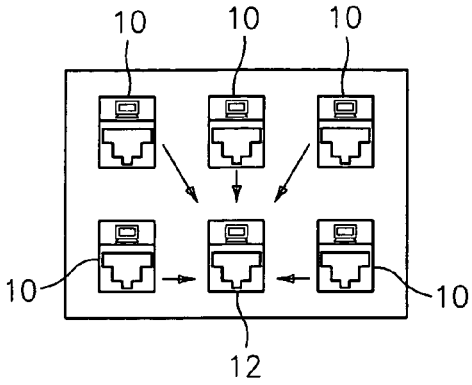
FIG. 1A illustrates alien crosstalk between outlets.
Figure 1B:
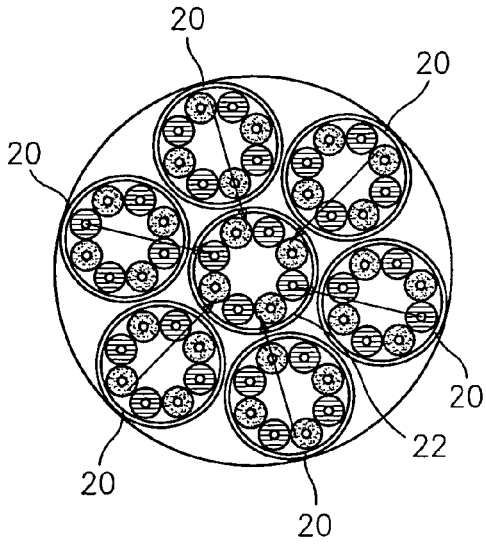
FIG. 1B illustrates alien crosstalk between cables.

Alien crosstalk is a measure of unwanted signal coupling from one or more pairs from one channel (or more) to a neighboring adjacent channel, expressed in decibels. FIGS. 1A and 1B show conceptual drawings of alien crosstalk in a cluster of connectors and cables. In FIG. 1A, outlets 10 are depicted contributing alien crosstalk to outlet 12. The outlets 10 and 12 are connected to cables and patch cords in a channel and are subject to alien crosstalk from the neighboring connectors as shown. In FIG. 1B, cables 20 are depicted contributing alien crosstalk to cable 22.

Alien crosstalk is a very difficult parameter to model due to its random statistical nature. The affects of alien crosstalk are best described using the powersum mathematical relationship. The requirements specified by TIA and IEEE are in the form of Powersum alien NEXT and Powersum alien ELFEXT as shown below:

PS $ANEXT_k$ of pair k is computed as follows:

$$PSANEXT_k = -10\lg \sum_{i=1, i\neq k}^{n} 10^{\frac{-ANEXT_{ik}}{10}} \tag{6}$$

where i is the number of the disturbing pair;

k is the number of the disturbed pair;

n is the total number of disturbing pairs;

$ANEXT_{ik}$ is the alien near end crosstalk loss coupled from pair i into pair k.

In exemplary embodiments, within each connector and through the channel there are 4 pairs of wires. Powersum adds the noise from the different combinations for each pair, 1 through 4. For example, each connector has four pairs, P1, P2, P3 and P4. The noise from each connector to the victim connector for each pair combination is summed (P1/1, P2/1, P3/1, P4/1) for each connector that surrounds the victim. The TIA test method calls for 6 connectors to surround the victim cable. The affects of all pair 1 combinations are then summed together. The worse case alien crosstalk coupling occurs with pairs exhibiting similar twist rates. The response of the multiple disturbers to one (of 4 possible) victim pair is summed to obtain the mathematical powersum coupling.

The like pair responses tend to add and can cause spikes in the data due to the powersum formula. To minimize the spikes of like pair combinations, it is advantageous to limit the likeness of cables and connectors in the surrounding area. This can be done in several ways as described herein.

Figure 2A:
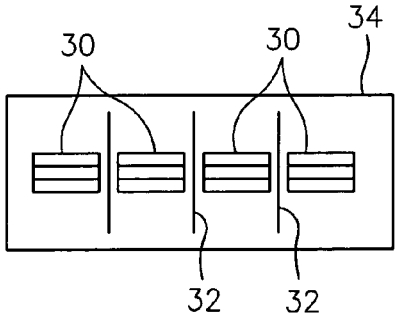
FIGS. 2A-2C illustrate shielded connecting blocks.
Figure 2B:
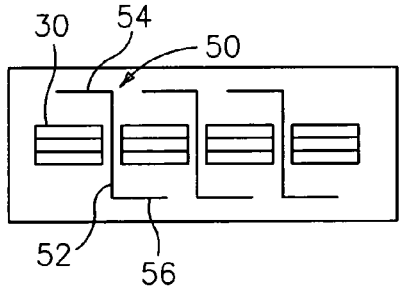
Figure 2C:
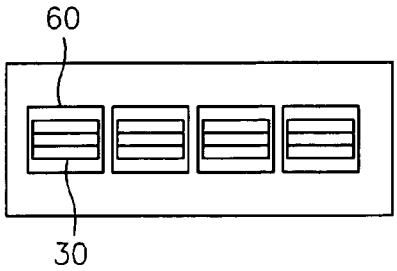

Embodiments of the invention use shielding to reduce the alien crosstalk. FIGS. 2A-2C show a rear view of patch panels, such as the MAX brand patch panels available from The Siemon Company. As known in the art, the patch panel includes a number of outlets on a front face, with connecting blocks 30 on the rear face for terminating wires. The connecting blocks 30 may be S310 brand connecting blocks available from The Siemon Company.

Figure 3A:
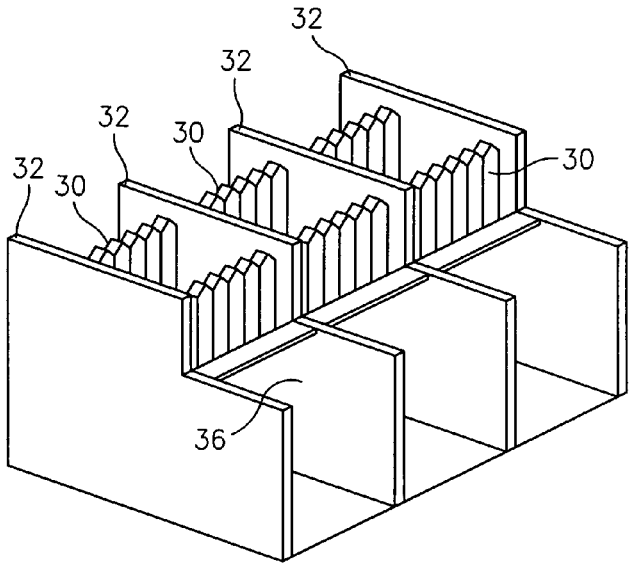
FIGS. 3A-3B illustrate shield elements.

FIGS. 2A-2C illustrate different types of shielding that may be employed at the connecting blocks 30 of a patch panel. As shown in FIG. 2A, shields 32 are planar and extend along one side of a connecting block 30. Shields 32 may be integrally formed from part of the patch panel metal frame 34. FIG. 3A illustrates a rear perspective view of a patch panel having connecting blocks 32 extending through openings 36. Metal tabs are bent from the metal patch panel frame 34 to define shields 32 positioned between connecting blocks 30.

Figure 3B:
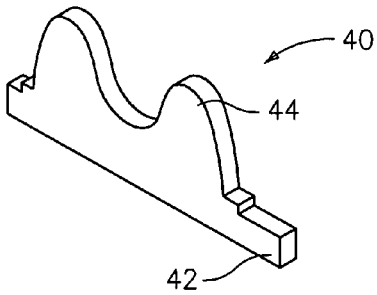

In alternate embodiments, a separate element is used to provide the shield 32 as shown in FIG. 3B. FIG. 3B depicts a separate shield element 40 that may be positioned between connecting blocks 30. Shield element 40 includes a base section 42 that is positioned at the base of the connecting block 30. An upper section 44 of the shield element 40 is shaped to follow the contour of the connecting block 30.

Referring to FIG. 2B, an alternate embodiment is depicted in which a shield 50 has a z-shape for covering multiple sides of the connecting blocks. The shield 50 includes a first section 52 positioned between a first and second connecting block. A first extension 54 is perpendicular to section 52 and extends along the first connecting block. A second extension 56 is perpendicular to section 52 and extends along the second connecting block. By using multiple z-shaped shields 50, all four sides of a connecting block may be shielded. The shield 50 may be formed integrally with the patch panel metal frame 34 or be separate elements.

Figure 4:
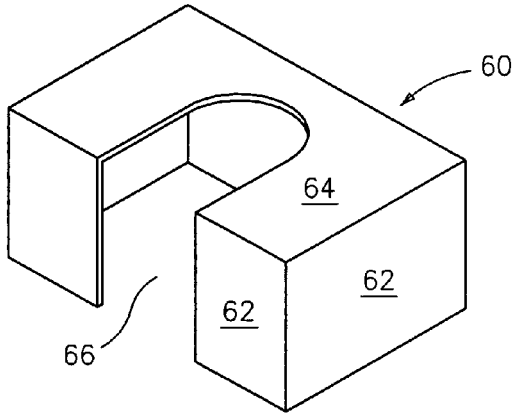
FIG. 4 illustrates an alternate shield.

FIG. 2C illustrates an alternate embodiment in which a shield 60 encompasses all four sides, and top, of connecting block 30. FIG. 4 illustrates shield 60 in an exemplary embodiment. Shield 60 includes four sidewalls 62 arranged in a rectangle and a top wall 64. One sidewall 62 and top wall 64 have a cutout 66 to allow the shield 60 to fit over a cable terminated to connecting block 30. In installation, a cable may be terminated to connecting block 30 and the shield 60 subsequently positioned over connecting block 30 with the cable positioned in cutout 66.

Figure 5:
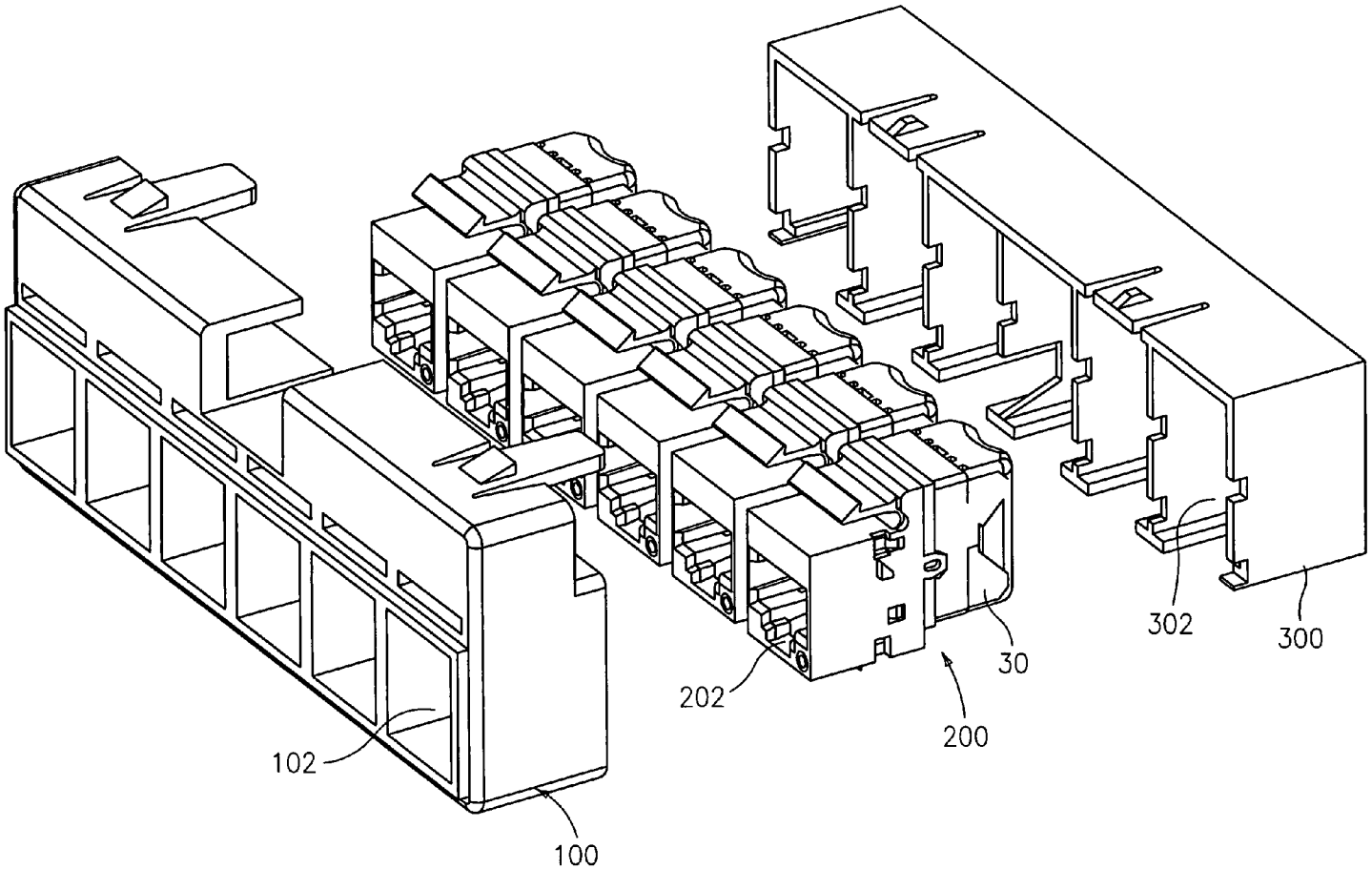
FIG. 5 is an exploded perspective view of a patch panel assembly.

FIG. 5 is an exploded perspective view of a 6 port patch panel assembly. The patch panel assembly includes a 6 port housing 100, 6 jacks 200 and a cover 300. Jacks 200 may be MAX 6 brand modules available from The Siemon Company. The housing 100 includes openings 102 for receiving outlets 202 of jacks 200. The jacks 200 includes keystone-type latch to secure the outlet 200 in the housing 100 as known in the art.

Figure 6:
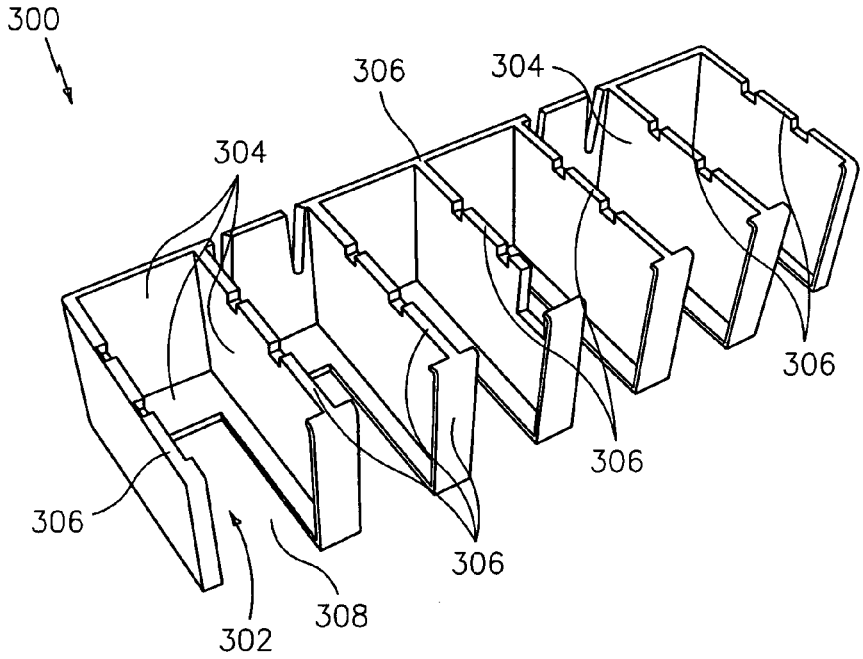
FIG. 6 is a perspective view of a cover.

The cover 300 includes a number of rectangular bays 302 for receiving connecting blocks 30 and cables terminated to connecting blocks 30. The cover 300 may be made from plastic, which is this selectively metalized to form shields for the connecting blocks 30. FIG. 6 is a perspective view of the cover 300. The interior surfaces 304 of bays 302 are metalized to shield the connecting block 30. During the metallization process, regions 306 are masked off such that the metalized interior of one bay 302 is not in electrical connection with the metalized interior of an adjacent bay 302. This reduces the chance of alien crosstalk being transmitted between adjacent jacks and/or cables connected to the jacks. As described above with reference to FIG. 4, each bay 302 includes a cutout 308 in a side wall and top wall to accommodate a cable terminated at connecting block 30.

The housing 100 may also be shielded in the same manner as cover 300. Each opening 102 may have its interior metalized to form shields for the outlets 202 of jacks 200. As described above, the shielded interior of each opening 102 is not in electrical connection with metalized interior of an adjacent bay. The cover 100 may be masked during metallization to electrically isolate each opening. This provides shielding along the entire jack 200.

The shields utilized in embodiments of the invention may be formed from metal, conductive plastic, electro-plated plastic, or insert molded metal shields. In other embodiments, shielded jacks may be used in the patch panel. The jacks may be metal plated, e.g., with copper or other metallic tape, or utilize conductive plastics to further prevent alien near end crosstalk (NEXT) and alien far end crosstalk (FEXT) from port to port on the face of the patch panel. The shield elements used in the multiple embodiments may be connected to ground or alternatively may be unconnected in a floating shield configuration. The application and desired shielding effect may dictate how one or more shield elements are electrically connected.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A patch panel comprising:

a first jack having a first connecting block;

a second jack having a second connecting block, the second connecting block positioned adjacent to the first connecting block;

a conductive shield positioned between the first connecting block and the second connecting block to reduce alien crosstalk;

wherein the conductive shield includes four sidewalls surrounding the first connecting block and a top wall, a first sidewall and the top wall having a cutout to allow the conductive shield to fit over a cable terminated to the first connecting block.

2. A patch panel comprising:

a first jack having a first connecting block;

a second jack having a second connecting block, the second connecting block positioned adjacent to the first connecting block;

a conductive shield positioned between the first connecting block and the second connecting block to reduce alien crosstalk;

wherein the conductive shield is a cover including a first bay for receiving the first connecting block and a second bay for receiving the second connecting block; the first bay including a first conductive shield surface and the second bay including a second conductive shield surface;

wherein the first conductive shield surface and the second conductive shield surface are electrically isolated.

3. The patch panel of claim 2 wherein:

the first bay includes four sidewalls surrounding the first connecting block and a top wall, a first sidewall and the top wall having a cutout to allow the cover to fit over a cable terminated to the first connecting block.

4. The patch panel of claim 2 wherein:

the second bay includes four sidewalls surrounding the second connecting block and a top wall, a first sidewall and the top wall having a cutout to allow the cover to fit over a cable terminated to the second connecting block.

5. A patch panel comprising:

a first jack having a first connecting block;

a second jack having a second connecting block, the second connecting block positioned adjacent to the first connecting block;

a conductive shield positioned between the first connecting block and the second connecting block to reduce alien crosstalk;

a housing including a first opening receiving a first outlet of the first jack and a second opening receiving a second outlet of the second jack, the first opening including a first conductive shield surface and the second opening including a second conductive shield surface, the first shield surface and the second shield surface being electrically isolated;

wherein the conductive shield is a cover including a first bay for receiving the first connecting block and a second bay for receiving the second connecting block; the first bay including the first conductive shield surface and the second bay including the second conductive shield surface.

6. The patch panel of claim 5 wherein:

the first bay includes four sidewalls surrounding the first connecting block and a top wall, a first sidewall and the top wall having a cutout to allow the cover to fit over a cable terminated to the first connecting block.

7. The patch panel of claim 5 wherein:

the second bay includes four sidewalls surrounding the second connecting block and a top wall, a first sidewall and the top wall having a cutout to allow the cover to fit over a cable terminated to the second connecting block.

* * * * *